United States Patent [19]

Brown

[11] 3,991,537

[45] Nov. 16, 1976

[54] CHAIR RAIL

[76] Inventor: Russell L. Brown, P.O. Box 14546, Oklahoma City, Okla. 73114

[22] Filed: Aug. 20, 1973

[21] Appl. No.: 389,942

[52] U.S. Cl. ..... 52/717; 52/312; 248/188.8; 248/345.1

[51] Int. Cl.[2] ..... E04F 19/02; A47B 95/00

[58] Field of Search ..... 52/716–718, 52/242, 312; 248/345.1, 188.8; 16/86 A; 49/460, 469, 490; 182/46; 293/1, 62, 67, DIG. 4

[56] References Cited

UNITED STATES PATENTS

| | | | |
|---|---|---|---|
| 2,100,959 | 11/1937 | Hurxthal | 182/46 |
| 2,851,744 | 9/1958 | Oehmig | 49/490 |
| 3,014,253 | 12/1961 | Manville | 49/469 |
| 3,173,826 | 3/1965 | Campbell et al. | 248/345.1 |
| 3,451,709 | 6/1969 | Swauger | 293/1 |
| 3,565,478 | 2/1971 | George | 52/717 |
| 3,606,431 | 9/1971 | Kunevicius | 52/718 |
| 3,775,926 | 12/1973 | Brown | 52/717 |

*Primary Examiner*—James L. Ridgill, Jr.
*Attorney, Agent, or Firm*—Laney, Dougherty, Hessin & Fish

[57] ABSTRACT

A chair rail which includes an elongated rigid rail member having a channel centrally positioned on one side thereof and extending over the length of the rail member, a bumper strip of resilient material slidably positioned in the channel and protruding outwardly from the rail member for protecting the rail member against shocks and impacts, and a base plate adapted to be secured to a supporting surface and having a structure associated therewith for snap on connection of the rail member thereto.

4 Claims, 3 Drawing Figures

CHAIR RAIL

BACKGROUND OF THE INVENTION

1. Field of the Invention

This invention relates to chair rails, and more particularly, to rails including rigid structure having mounted thereon, a resilient bumper strip for preventing the rigid structure from being dented or damaged by contact with chairs or other articles moved forceably against the chair rail.

BRIEF DESCRIPTION OF THE PRIOR ART

Heretofore, various constructions of chair rails have been proposed, and consideration has been given to constructing such rails so that they may sustain relatively high force impacts without damage or disfigurement of the rail. To the end of providing a cushioning surface, a frequent practice has been to provide a rigid rail which is frequently extruded and which has grooves or channels formed therein for receiving an elastomeric member which projects outwardly from the rail in the direction therefrom from which an impacting article such as a chair or rolling table is apt to travel. The elastomer is thus initially contacted by the impacting article, and through its resiliency, is able to absorb most of the shock force and return to its original configuration without damage or disfigurement. The shielding effect of the elastomer protects the rigid metallic rail portion of the chair rail from being bent or marred.

Another consideration which is of importance in the design of chair rails in the present day, particularly those for installation in heavily used public buildings, is to construct the chair rail in such manner that it is difficult for vandals to rip or detach the chair rail from the wall upon which it is mounted, or to tear parts of the chair rail assembly loose to render it ineffective or unsightly. Such vandalism has been increasing in frequency on an alarming scale in recent years, and it is therefore a matter of considerable concern that installations of structures of this type in public buildings be capable of resisting or preventing vandals from rendering the structure inoperative or unsightly.

BRIEF DESCRIPTION OF THE PRESENT INVENTION

Broadly described, the shock absorbing chair rail of the present invention includes an elongated rail having an elongated channel extending over its length at the central portion thereof, an elastomeric bumper strip slidably positioned in the channel and projecting outwardly therefrom and from the rail, and a base plate adapted to be secured to a surface upon which the chair rail is to be mounted. The base plate engages the rail by a snap connection which, when a pair of terminal caps are in place at opposite ends of the rail, renders the assembly very difficult for vandals to remove or damage.

An important object of the invention is to provide a chair rail structure which can receive bumps and impact forces imposed by inadvertently displaced furniture without being dented or marred, and without damaging such furniture.

An additional object of the invention is to provide a shock absorbing chair rail which functions effectively in protecting a surface upon which it is mounted, and which is very attractive in appearance when mounted in its protective position.

Another object of the invention is to provide a chair rail construction which includes relatively few parts, can be quickly and easily assembled and which is resistant to vandalism when installed.

Additional objects and advantages of the invention will become apparent as the following detailed description of the invention is read in conjunction with the accompanying drawings which illustrate the invention.

BRIEF DESCRIPTION OF THE DRAWINGS

FIG. 3 is a view partly in section and partly in elevation of an end portion of the chair rail taken along a vertical plane passed through the chair rail.

DETAILED DESCRIPTION OF A PREFERRED EMBODIMENT OF THE INVENTION

Figure 1:
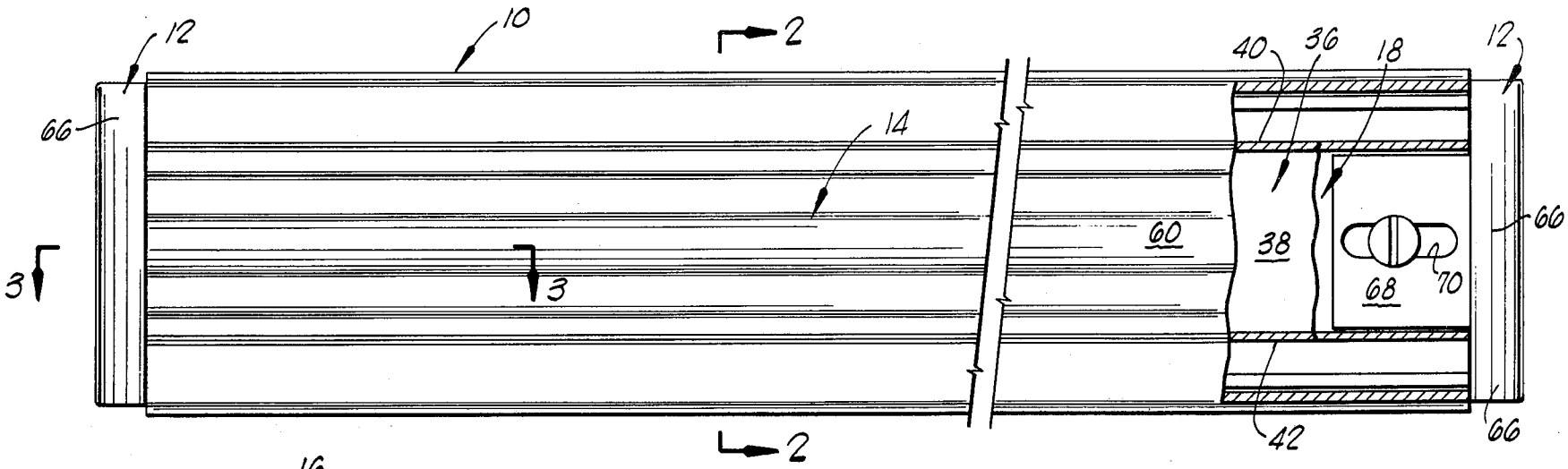
FIG. 1 is a front elevation view of a chair rail constructed in accordance with the present invention, with parts broken away and shown in section at one end of the chair rail to illustrate the relationship of certain parts of the chair rail to each other.
Figure 5:
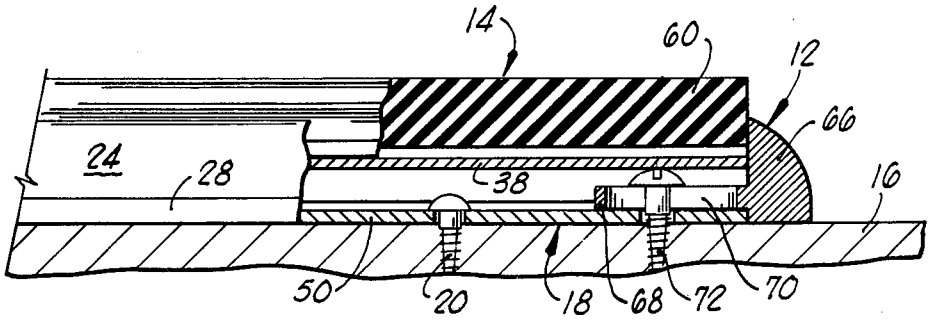
Figure 2:
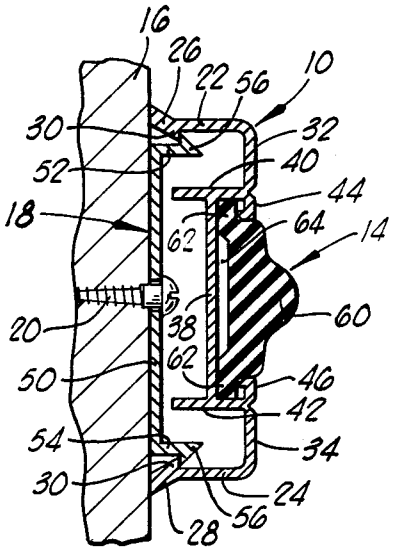
FIG. 2 is a sectional view taken along line 2—2 of FIG. 1.

Referring initially to FIG. 1 of the drawings, shown therein is a chair rail constructed in accordance with the present invention and including an elongated rail member 10 having a pair of terminal caps 12 positioned at opposite ends thereof and carrying along its central portion, a bumper strip 14 of elastomeric material. The chair rail is customarily mounted in a horizontally extending position along a wall 16 as depicted in FIGS. 2 and 3, although it will be understood that it can, in some instances, usefully be extended vertically on a wall. For the purpose of securing the chair rail to the wall 16, the chair rail assembly includes, as a further element thereof, a base plate 18 which is substantially coextensive in length with the rail member 10, and which is provided with apertures along the length thereof to facilitate the insertion therethrough of screws 20 or other suitable fastening elements for fastening the base plate to the wall.

The rail member 10 is constructed in a manner which can be best perceived by reference to FIG. 2 of the drawings. It will be noted that the rail member is of generally U-shaped cross-section, and is provided with a pair of legs 22 and 24 at the opposite sides thereof, with the legs being flared outwardly at terminal toe portions 26 and 28 thereof. Each of the toe portions 26 and 28 has a heel or barb 30 formed on the inner side thereof for a purpose hereinafter described.

In addition to the legs 22 and 24, the rail member 10 is provided with a pair of outer faces 32 and 34 which extend in a common plane at right angles to the legs, and which lie on opposite sides of an elongated channel 36 which extends over the length of the rail member 10. The channel 36 is defined by a transverse plate 38 and a pair of parallel side plates 40 and 42. The transverse plate 38 and side plates 40 and 42 together form a structure which is of I-shaped cross-section, and it will be perceived that the side plates are joined to and, in a preferred construction, formed integrally with, the faces 32 and 34. It will also be noted in referring to FIG. 2 that the side plates 40 and 42, defining the opposite sides of the channel 36, project nearly to the base plate 18, but are spaced slightly therefrom for a reason hereinafter described. Projecting from the faces 32 and 34 into the channel 36 are a pair of retainer toes 44 and 46. The retainer toes 44 and 46 have tapered lips formed on the inner ends thereof which project into the channel 36, with the lips projecting to a sharp edge, and their taper being in the direction of the transverse plate 38.

The construction of the base plate 18 is also best illustrated in FIG. 2 of the drawings. As there shown, the base plate 18 includes a web portion 50 which extends across the transverse width of the base plate. The web portion 50 is joined at its opposite side edges to a pair of outwardly projecting legs 52 and 54 which extend at a right angle to the web portion so that the base plate is of generally U-shaped cross-sectional configuration. At their outer ends, each of the legs 52 and 54 carry an outwardly facing barb 56 which is positioned to engage or interlock by a snap-on connection with the barb 30 formed at the inner side of the toes 26 and 28 formed on the legs 22 and 24 of the rail member 10.

Positioned in the channel 36 is the elongated bumper strip 14 which is relatively thick at its mid portion and includes, at this location, a protuberant, convexly shaped bead 60. The bead 60 protrudes outwardly from the channel 36 and from the rail member 10 in which the channel is formed. At the opposite longitudinal side of the bumper strip 14, the strip carries a pair of relatively thin edge portions each designated by the reference numeral 62. The edge portions 62 are sufficiently thin to permit the bumper strip to be slid or forced endwise into the elongated channel 36. Moreover, the taper of each of the retainer toe lips to a sharp edge also facilitates insertion of the bumper strip 14 in the channel 36 in this manner, since the contact between the bumper strip and the tapered lips is essentially a line contact giving minimum frictional resistance to insertion. It will be noted, however, that the taper of the lips on the toes 44 and 46 to the sharp edge is in a direction such that they tend to bite into the edge portions 62 of the bumper strip 14 if it should be attempted to pry the bumper strip out of the channel 36. The geometric configuration of the bumper strip 14 is further such that an air space or void 64 exists beneath the central, relatively thick portion of the bumper strip when the bumper strip is inserted in the channel 36.

At the opposite ends of the rail member 10 and the bumper strip 14 which it carries, the assembly is completed by the positioning in juxtaposition to the ends of the rail of a pair of terminal caps 12. The terminal caps 12 are each constructed to have an external, substantially quarter round portion 66 which extends from side to side of the rail member 10. The quarter round external portion 66 of each terminal cap 12 is secured to, and preferably formed integrally with, a relatively thin mounting flange 68. The mounting flange 68 has a width such that it can be inserted between the side plates 40 and 42 of the rail member 10, and has an elongated slot 70 formed in the center thereof and extending parallel to the side edges of the mounting flange. A relatively large screw 72 is employed for extension through the elongated slot 70 and through one of the apertures or openings formed in the base plate 18 for the purpose of securing the terminal caps 12 in the assembled position depicted in FIGS. 1 and 2.

INSTALLATION AND UTILIZATION

The chair rail of the invention is installed by initially placing the base plate 18 in the position on the wall or other supporting structure where the chair rail is to be mounted. In positioning the base plate 18, sufficient room is left at opposite ends of the base plate to permit the terminal caps 12 to be mounted in the location shown without overlapping, or encountering interference afforded by, door jambs or the like. In securing the terminal caps 12 to opposite ends of the base plate 18, the thin mounting flange 68 forming a part of each of the terminal caps 12 is inserted into the opening formed between the web portion 50 of the base plate, the transverse plate 38 of the rail member 10 and the two side plates 40 and 42 forming a portion of the rail member. In this position, the mounting flange 68 will project over at least one of the slots or openings formed through the web portion 50 of the base plate 18 to facilitate securement in this position by the use of the screw 72. The elongation of the slot 70 assures that a location will be available at which one of the screws 72 can be extended through an aligned opening formed through the web portion 50 of the base plate 18.

When the base plate 18 and the terminal caps 12 have been mounted in the manner described, the rail member 10 carrying the bumper strip 14 is ready for securement to the base plate 18 by snap engagement therewith. It should be pointed out that prior to effecting such securement, the bumper strip 14 has been positioned within the channel 36 formed in the central portion of the rail member 10 by forcing the bumper strip in an endwise direction into the channel. Such sliding insertion of the bumper strip 14 in the channel 36 can be accomplished by reason of the relatively thin and yielding character of the thin edge portions 62 of the bumper strip, and because these edge portions are contacted only by the sharpened edge portions of the tapering lips formed on the retainer toes 44 and 46. When the bumper strip has been thus inserted and has been squared off flush with the ends of the elongated rail member 10, the rail member is forced over the base plate 18 so that the barbs 56 on the projecting legs 52 and 54 of the base plate snap over and lockingly engage the barbs 30 formed on the inside of the legs 22 and 24 forming a part of the rail member 10.

It will be noted that in order to accomplish the described snap engagement between the rail member 10 and the base plate 18, the legs 22 and 24 of the rail member must yield outwardly or divergently slightly to enable the barbs 30 carried thereon to by-pass the barbs 56 carried on the legs 52 and 54 of the base plate. It will also be noted that once the rigid rail member 10 has been snapped over and interlocked with the base plate 18 in this manner, the side plates 40 and 42 of the rail member extend into close proximity to the web portion 50 of the base plate, but are still slightly spaced therefrom.

The rail member 10 is constructed with the depicted and described geometry so that the side plates 40 and 42 can function as a backup shock absorbing feature to prevent permanent distortion or damage to the chair rail, but which yet do not interfere with the snap engagement effected between the base plate 18 and the rail member 10 when the chair rail is being assembled. Thus, upon an impact being delivered to the chair rail by forceable contact of an article of furniture, such as a rolling table in a hospital, with the protuberant bead 60 of the bumper strip 14, there will initially be a resilient yielding of the bumper strip which is resisted by the inherent resiliency of the bumper strip, and also by the air entrapped in the air space or void 64 under the thick central portion of the bumper strip. If the impacting force exceeds the limit of yield of the bumper strip or if, due to projecting corners or the like, the outwardly facing portion of the rail member 10 proper should be contacted by the moving object, the rail member can yield inwardly at its central portion in the direction of the base plate 18. Such yielding movement can occur until the ends of the side plates 40 and 42 adjacent the web portion 50 of the base plate contact this web portion. At this point, no further yielding movement can be realized, but the major portion of the impact forces will have been absorbed and dissipated. The geometry of the rail member 10, coupled with such inherent resiliency as the metal from which it is constructed will generally have, will permit a return of the rail member from this slightly distorted configuration to its normal configuration as shown in FIG. 2. That is, after the impact, the outer faces 32 and 34 and the side plates 40 and 42 will move away from the base plate to allow the rail member to return to its undistorted configuration. It will be perceived that the side plates 40 and 42 do not, however, project so close to the web portion 50 of the base plate 18 as to result in an inability to effect snap engagement between the rail member 10 and the base plate in the event there should be some dimensional variations due to the tolerances in the manufacture of the base plate and rail member.

When the chair rail has been mounted in the manner described, it is difficult to damage or remove it through acts of vandalism. Attempts to pry out the bumper strip 14 from its functioning position in the channel 36 are resisted by the protection of the ends of the bumper strip by the quarter round portions 66 of the terminal caps 12. Moreover, efforts to pry off the bumper strip 14 are also resisted by the biting action of the edges of the tapered lips formed on the retainer toes 44 and 46. The terminal caps 12 themselves resist removal since the screws 72 which secure them in position are obscured from view, and are in a protected position on the interior of the assembly and beneath the transverse plate 38 of the rail member. Finally, it is difficult to pry the rail member 10 off the base plate 18, because once the snap engagement of the rail member with the base plate has been effected, the interconnecting joint or snap fit is on the inside of the assembly and access cannot be had thereto due to the protective positioning of the terminal caps 12 and the fact that the terminal toe portions 26 and 28 of the rail member bear against the wall 16 or other supporting surface, thus preventing insertion of a screwdriver or other prying instrument into a position such that the snap engagement can be released.

Although a preferred embodiment of the present invention has been herein described, in order to afford an example to those skilled in the art of the manner of usage of the principles of the invention, it will be understood that various changes and modifications in the described structure can be effected without departure from the basic principles which underlie the invention. Changes and innovations of this type are therefore deemed to be circumscribed by the appended claims, or reasonable equivalents thereof.

What is claimed is:

1. A chair rail comprising:

an elongated, rigid base plate of generally U-shaped cross-section adapted to be secured to a supporting surface and including:

a web portion;

a pair of substantially parallel legs projecting at right angles from the opposite sides of said web portion; and locking barbs carried on said legs;

an elongated, rigid rail member of generally U-shaped cross-section, said rigid rail member including:

a pair of parallel legs constituting opposite sides of said rigid rail member and projecting toward said base plate in a direction substantially normal to the web portion thereof;

spaced, substantially coplanar elongated faces each connected at one side edge to one of said second-mentioned parallel legs of said rail member and extending substantially normal thereof; and an elongated rigid structure of I-shaped cross-section positioned between and interconnecting said substantially coplanar faces, and defining an elongated channel extending the length of said rail member, said rigid structure of I-shaped cross-section including:

a transverse plate extending parallel to the web portion of said base plate; and a pair of parallel side plates secured to the opposite side edges of the transverse plate and extending substantially normal to the plane of the transverse plate in planes projecting normal to the web portion of the base plate, said side plates projecting into close proximity to said base plate but being spaced therefrom to permit yielding of the rigid structure of I-shaped cross-section in a direction toward the base plate until said side plates contact the web portion of said base plate;

an elongated, elastomeric bumper strip slidably positioned in said channel and extending from one end of said rigid rail member to the other; and terminal caps secured to said base plate at the opposite ends thereof and retaining said bumper strip against sliding movement in said channel, said terminal caps each including a portion lying between said elongated elastomeric bumper strip and the web portion of said generally U-shaped base plate and thus hidden from view, said portion of each of said terminal caps being the point of securement of each of said terminal caps to said base plate whereby the means used to secure said terminal caps to said base plate are hidden from view.

2. A chair rail as defined in claim 1 and further characterized as including:

a pair of spaced elongated retainer toes projecting from each of said faces into said channel, each of said retainer toes being of L-shaped cross-section and having a portion extending parallel to said transverse plate and over said channel, and each of said retainer toes including a lip projecting toward said transverse plate and tapered to an edge on the portion of said lip nearest said transverse plate, said lip taper being in the direction of the corner angle formed by the intersection of said transverse plate and the nearest of said parallel side plates whereby said bumper strip can be slidingly inserted in said channel in a longitudinal direction; and wherein said bumper strip is further characterized by including:

a thickened mid-portion defining a protuberant, concavely shaped bead projecting outwardly from the channel in a direction away from said transverse plate, said protuberant, concavely shaped bead being spaced outwardly from said transverse plate to define an air-containing shock-cushioning space therewith; and a pair of relatively thin edge portions on opposite sides of said bead and formed integrally therewith, said edge portions projecting under the edges of said retainer toe lips and engaged thereby whereby removal of the bumper strip from said channel by prying outwardly thereon is resisted by the retainer toe lip edges to biting into the thin edge portions of said bead.

3. A chair rail comprising:

an elongated, rigid rail member of generally U-shaped cross-section and having an elongated channel positioned centrally therein and extending over the length of the rail member, said rail member further having:

a pair of legs disposed on opposite sides thereof and having toe portions at the free end of each of said legs, said toe portions flaring outwardly with respect to the U-shaped rail member and divergently with respect to each other; and a barb on the inner side of each of said legs at the point of origin of the respective toe portion;

an elongated, elastomeric bumper strip slidably positioned in said channel and extending from one end of said rigid rail member to the other end thereof;

a generally U-shaped rigid base plate adapted to be secured to a supporting surface and engaged by a snap-on connection with said rigid rail member, said base plate including:

a web portion;

a pair of substantially parallel legs projecting at right angles from opposite sides of said web portion; and locking barbs carried on the legs of said base plate, said locking barbs each having a beveled surface thereon positioned so that the locking barbs engage and slidingly bias the toe portions of the rigid rail member outwardly and away from each other as the U-shaped rail member is forced over said U-shaped base plate for effecting snap engagement of said first-mentioned barbs and said locking barbs to thereby prevent vandalistic removal of said rail member from said base plate; and terminal caps secured to said base plate at the opposite ends thereof and retaining said bumper strip against sliding movement in said channel, said terminal caps each including a portion lying between said elongated elastomeric bumper strip and said generally U-shaped base plate and thus hidden from view, said portion of each of said terminal caps being the point of securement of each of said terminal caps to said base plate whereby the means used to secure said terminal caps to base plate are hidden from view.

4. A chair rail comprising:

an elongated base plate of generally U-shaped cross-sectional configuration adapted to be secured to a supporting surface, said base plate including:

an elongated web portion having a flat, substantially monoplanar surface on one side thereof for flatly abutting contact with said supporting surface, said web portion having a pair of elongated side edges at opposite sides thereof;

a pair of substantially parallel, elongated legs projecting at right angles from the opposite side edges of said web portion, and projecting from the surface of said web portion opposite the monoplanar surface thereof; and locking barbs carried on each of said legs, each of said barbs having a beveled surface thereon;

an elongated rail member of generally U-shaped cross-section snap engaged with said base plate and including:

a pair of elongated, parallel legs constituting opposite sides of the rail member and constituting the legs of said U-shaped cross-section, said second-mentioned legs extending normal to said base plate and substantially parallel to said first-mentioned legs, said second-mentioned legs each having a toe portion at the free end thereof, said toe portions flaring outwardly with respect to the U-shaped rail member, and divergently with respect to each other, and said second-mentioned pair of legs being disposed outside of said first-mentioned pair of legs so that such first-mentioned pair of legs is disposed between said second-mentioned pair of legs;

a barb on the inner side of each of said second-mentioned legs adjacent one of the legs of first-mentioned pair of legs, the barbs on said second-mentioned pair of legs being disposed at the points of origin of the respective toe portions carried on the legs of said second-mentioned pair of legs, and snap-engaging the locking barbs carried on said first-mentioned legs;

spaced, substantially, coplanar faces extending the length of said rail member and each having a longitudinal side edge secured to one of said second-mentioned parallel legs at a longitudinal edge thereof, and projecting from the respective second-mentioned parallel leg to which it is secured toward the other of said second-mentioned parallel legs;

a channel-defining structure of I-shaped cross-section centrally positioned in said rail member and extending the length thereof, said channel defining structure of I-shaped cross-section being connected to and positioned between, said substantially coplanar faces and cooperating with said coplanar faces for interconnecting said second-mentioned parallel legs constituting opposite sides of said rail member, said channel defining structure of I-shaped cross-section, including:

a transverse plate extending parallel to said base plate;

a pair of parallel side plates secured to the side edges of said transverse plate and extending normal thereto, each of said parallel side plates including portions projecting from said transverse plate toward said base plate with each of said portions terminating at a longitudinal edge spaced from the web portion of said base plate whereby said rail member can yield at the central portion thereof in the direction of said base plate, and move toward said base plate until the longitudinal edges of said side plates contact the web portion of said base plate; and a pair of spaced, elongated retainer toes projecting from each of said faces into a channel defined by said channel-defining member, and projecting toward each other from said faces and over said transverse plate, each of said retainer toes being of L-shaped cross-section and having a portion extending parallel to said transverse plate and over said channel, and each of said retainer toes including a lip projection toward said transverse plate and tapered to an edge on the portion of said lip nearest said transverse plate, said lip taper being in the direction of the corner angle formed by the intersection of said transverse plate and the nearest of said parallel side plates;

an elongated, elastomeric bumper strip slidably positioned in said channel and extending from one end of said rigid rail member to the other, said bumper strip including:

a thickened mid-portion defining a protuberant, concavely shaped bead projecting outwardly from the channel in a direction away from the transverse plate and through the plane defined by said substantially coplanar faces, said protuberant, concavely shaped bead being spaced outwardly from said transverse plate and defining therewith an air-containing, shock-cushioning space; and a pair of relatively thin edged portions on opposite sides of said protuberant bead and formed integrally therewith, said edge portions projecting under the edges of the tapered lips of said retainer toes and engaged by such tapered lips whereby removal of the bumper strip from said channel by prying outwardly thereon is resisted by the retainer toe lip edges biting into the thin edge portions of said bead; and terminal caps secured to said base plate at the opposite ends thereof and retaining said bumper strip against sliding movement in said channel, said terminal caps each including a portion lying between said elongated, elastomeric bumper strip and said generally U-shaped base plate and thus hidden from view, said portion of each of said terminal caps being the point of securement of each of said terminal caps to said base plate whereby the means used to secure said terminal caps to said base plate are hidden from view.

* * * * *